United States Patent [19]

Feldman et al.

[11] Patent Number: 4,695,106

[45] Date of Patent: Sep. 22, 1987

[54] SURFACE MOUNT, MINIATURE CONNECTOR

[75] Inventors: Steven Feldman, Seminole; Robert J. Tennant, Largo, both of Fla.

[73] Assignee: AMP Incorporated, Harrisburg, Pa.

[21] Appl. No.: 733,176

[22] Filed: May 13, 1985

[51] Int. Cl.[4] ..... H01R 9/09

[52] U.S. Cl. ..... 439/83; 439/108; 439/874

[58] Field of Search ..... 339/14 R, 17 R, 17 D, 339/17 C, 17 LC, 17 L, 17 CF, 176 M, 176 MP, 191 R, 192 M, 221 R, 221 M, 275 B, 17 M, 17 LM

[56] References Cited

U.S. PATENT DOCUMENTS

| | | | |
|---|---|---|---|
| 3,384,864 | 5/1968 | Schwartz | 339/17 LC |
| 3,815,077 | 6/1974 | Anhalt et al. | 339/192 R |
| 3,904,934 | 9/1975 | Martin | 339/17 M |
| 3,963,319 | 6/1976 | Schumacher et al. | 339/176 MP |
| 4,133,592 | 1/1979 | Cobaugh et al. | 339/17 LC |
| 4,156,553 | 5/1979 | Ammon et al. | 339/221 M |
| 4,161,346 | 7/1979 | Cherian et al. | 339/17 M |
| 4,418,972 | 12/1983 | Benasutti | 339/207 R |
| 4,526,429 | 7/1985 | Kirkman | 339/221 M |
| 4,629,278 | 12/1986 | Norton et al. | 339/17 LC |

OTHER PUBLICATIONS

IBM Bulletin; Aug et al; vol. 19; No. 5; pp. 1835, 1836; 10-1976.

Teradyne, Technical Bulletin No. 237, pp. 8, 9, 1-1985.

*Primary Examiner*—Neil Abrams

*Attorney, Agent, or Firm*—Robert W. Pitts

[57] ABSTRACT

A surface mount electrical connector for use on printed circuit boards including plug and receptacle connectors is disclosed for use with parallel and perpendicular printed circuit boards. Box and pin terminals are positioned in rows adjacent a ground bus. The connectors are attached to the boards by posts on the ground bus. The terminals are insertable in cavities in the connector housings and can be retained in a partially inserted position. Mounting the connector housing on the printed circuit board independently inserts the terminals fully into housing cavities with compliant solder tails on each terminal being in contact with conductive pads on the boards despite deformities or warpage of the boards.

6 Claims, 9 Drawing Figures

22
22A
22B
20
14
18
14
12
16
4
28
F
26
24
D
10
E
38
A
32
30
2
A'
6

96
82C
82B
82
82A
80
4'
76A
78
88
74
76B
86
72
70
84
94
92A
92C
92
92B
90

22
22A
22B
20
14
18
14
12A
16
4
28
12B
26
24
10
38
32
30
2
6

SURFACE MOUNT, MINIATURE CONNECTOR

BACKGROUND OF THE INVENTION

Field of the Invention

The present invention relates to connectors for making an interconnection to a printed circuit board or the like and more particularly to connectors having a ground plane incorporated therein.

DESCRIPTION OF THE PRIOR ART

Conventional interconnections to printed circuit boards are established by using connectors employing pins which can be inserted through holes in a printed circuit board to establish connection with conductive traces on the surfaces of the printed circuit boards or with conductive layers embedded within the printed circuit board. These conventional pin-type connections can be accomplished by soldering the pin to the conductive traces on the surface of the printed circuit board. Alternatively solderless interconnections can be accomplished by employing press fit configurations to establish electrical continuity with plated-through holes defined in the printed circuit board. Alternatively connectors having contacts formed from a spring metal may be secured to a printed circuit board with the inherent resiliency of the contacts urging the contacts into engagement with pads or conductive traces on the printed circuit boards.

A more recent trend has lead to the surface mounting of leadless resistors, capacitors, transistors, integrated circuits and other components by using such techniques as vapor phase soldering and IR heating to reflow solder paste to connect the components directly to the surface of the printed circuit board. Surface mounting of components to printed circuit boards has lead to the achievement of higher density. This continued trend towards high density circuitry has created a need for miniature electrical connectors which can be mounted on the surface of a circuit board so that cost and board real estate required by plated-through holes used to conventionally mount known electrical connectors are eliminated. Surface mounting results in an inherently weaker solder joint than achieved by through hole soldering thus compounding problems such as inadequate engagement of the terminals with the board, cracking of the solder interface, and inadequate engagement with mating terminals of another connector. Other complications of known surface mount connectors include the requirement for a secondary fastening operation using screws, bolts, rivets, and heat stakes to take stress off of the solder interface. Conventional connectors modified for surface mounting typically have exposed terminals which are subject to handling damage, enclosed terminals which cannot be inspected, terminals which are not sufficiently compliant to withstand relative movement due to thermal and mechanical forces, and inadequate spacing to allow repair. Also, power and ground have required the dedication of an excessive number of terminals in the known connectors.

SUMMARY OF THE INVENTION

The present invention obviates many of the foregoing difficulties by providing a surface mount, miniature, bussing connector having a housing which defines a plurality of terminal passages extending between a mating face and a surface mount face, and a like number of terminals provided, each to establish a connection through a solder tail with a conductive trace on the printed circuit board. In order to ensure that a reliable contact is established with solder pads leading to the conductive traces on the printed circuit boards despite deformities in the printed circuit board or warpage of the housing, the individual terminals can be positioned in a partially inserted or preposition condition in which the terminals extend only partially into the cavities in the connector housing. A solder tail on the individual terminals extends beyond the surface of the housing to be mounted adjacent the printed circuit board. When the connector is positioned on the printed circuit board and secured to the printed circuit board each terminal is independently shifted further into the cavity from the partially inserted or preloaded position to ensure independent contact between each of the terminals and appropriate solder pads without residual stress in the solder tails. Vapor phase soldering or infrared heating or equivalent techniques can then be employed to form a solder bond with the solder tails on each terminal.

In the preferred embodiment of this invention, mating plug and receptacle connectors, each comprising a housing formed of an insulating material are intermatable to establish interconnection between two printed circuit boards. A ground bus affixed to one of the two connector housings and insertable into a groove in the mating connector housing, and alignment or retention posts extending from or attached to the ground bus can be inserted in appropriate holes in the printed circuit board to electrically connect ground paths on both boards. The ground bus is thus used to mount the connectors to the printed circuit board, to align the two connector housings for mating, and to establish a continuous ground. Alternate embodiments of this invention can employ multiple ground buses, one in each connector half or can employ the bus for power, or the buses for power and ground.

DETAILED DESCRIPTION OF THE PREFERRED EMBODIMENTS

Figure 1:
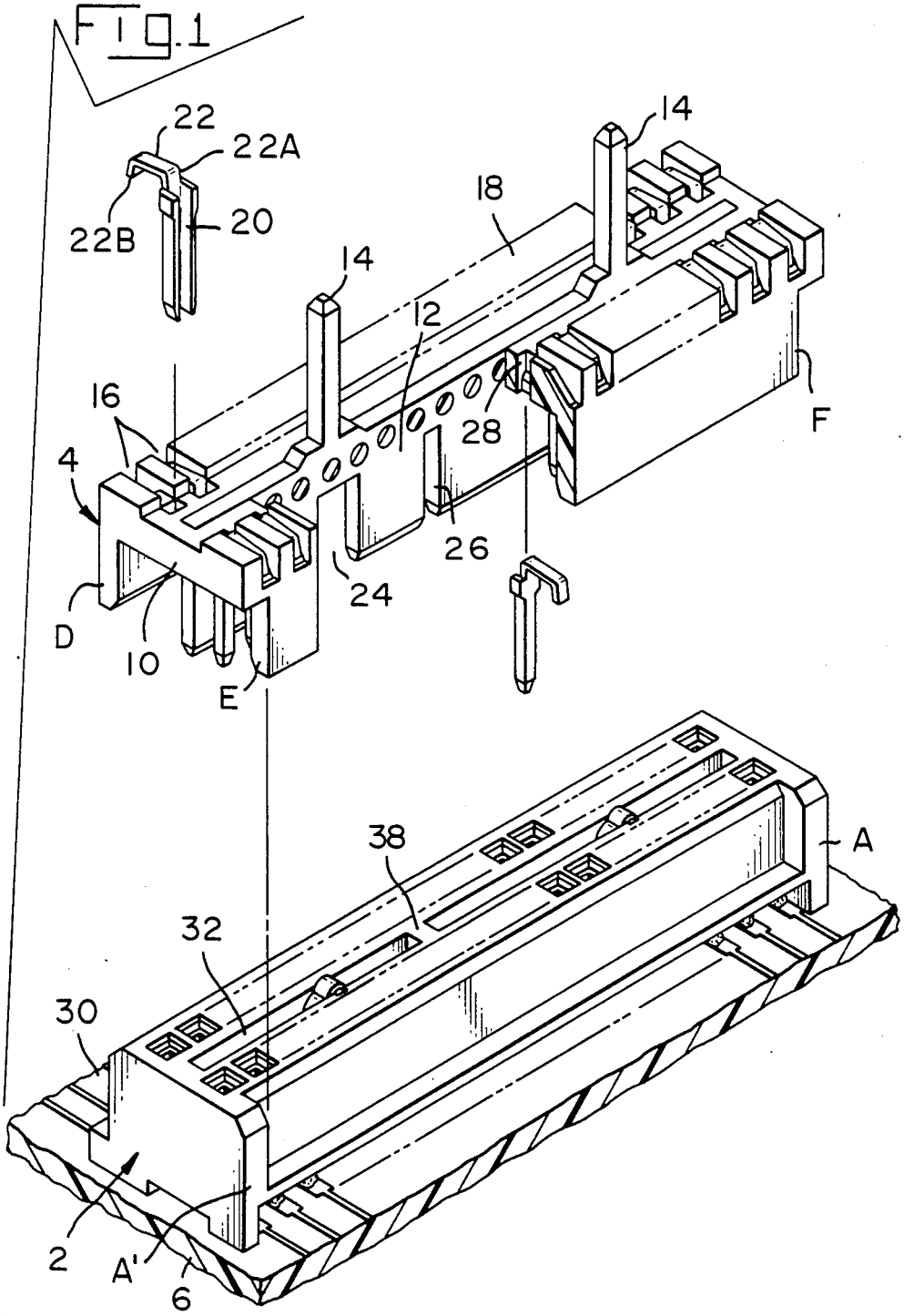
FIG. 1 is an exploded perspective view of a first connector to which a ground bus is attached shown in alignment with a second connector mounted on a printed circuit board.

The preferred embodiment of this invention comprises an assembly of mating connectors 2 and 4 for interconnecting corresponding conductive traces on opposed printed circuit boards 6 and 8. Each connector 2 and 4 can be mounted on the printed circuit board with respective terminals 20 and 40 in contact with conductive traces 55 on the surface of printed circuit boards.

Figure 2:
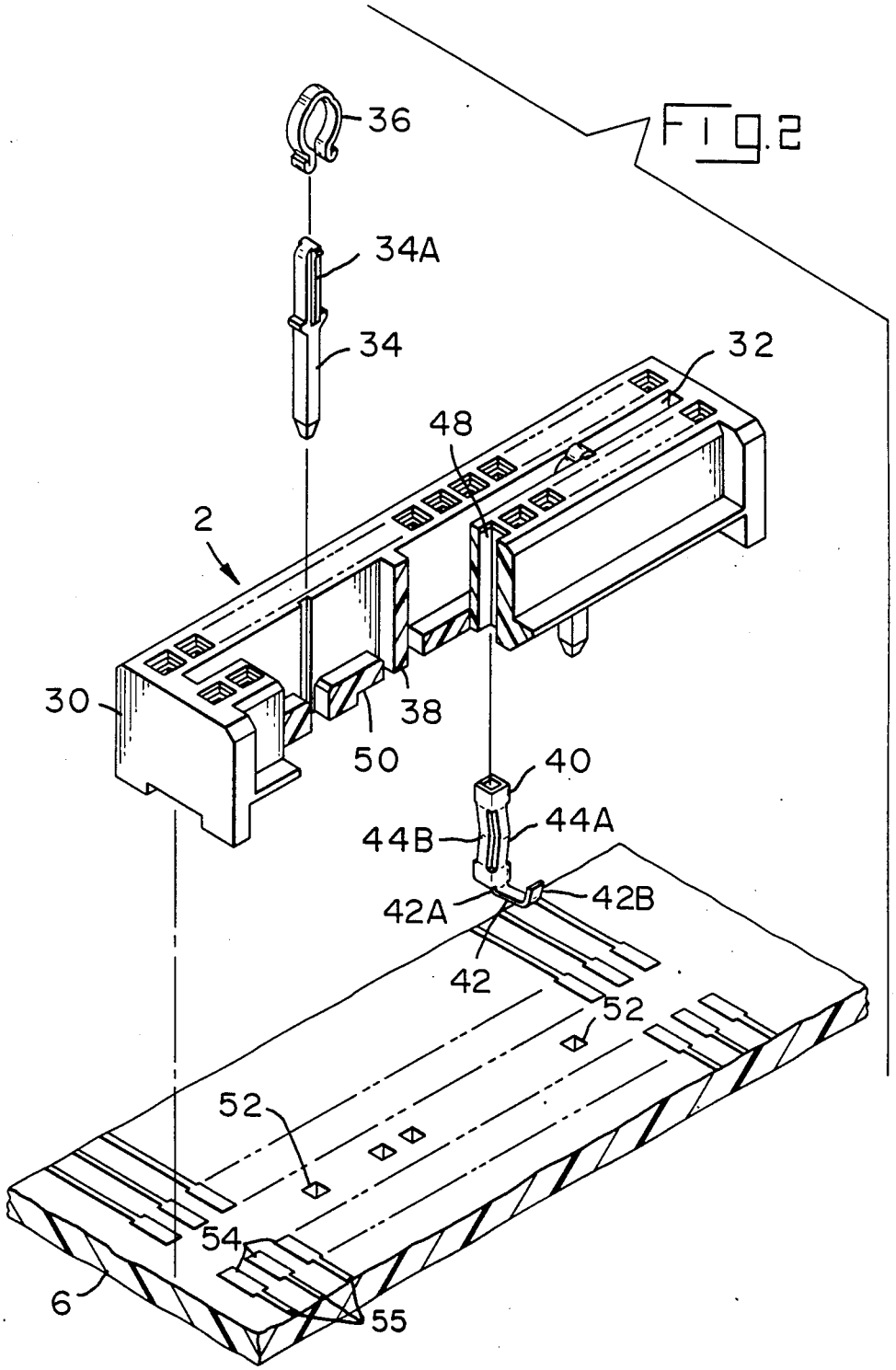
FIG. 2 is an exploded perspective view of the second connector housing mounted on the printed circuit board.
Figure 3:
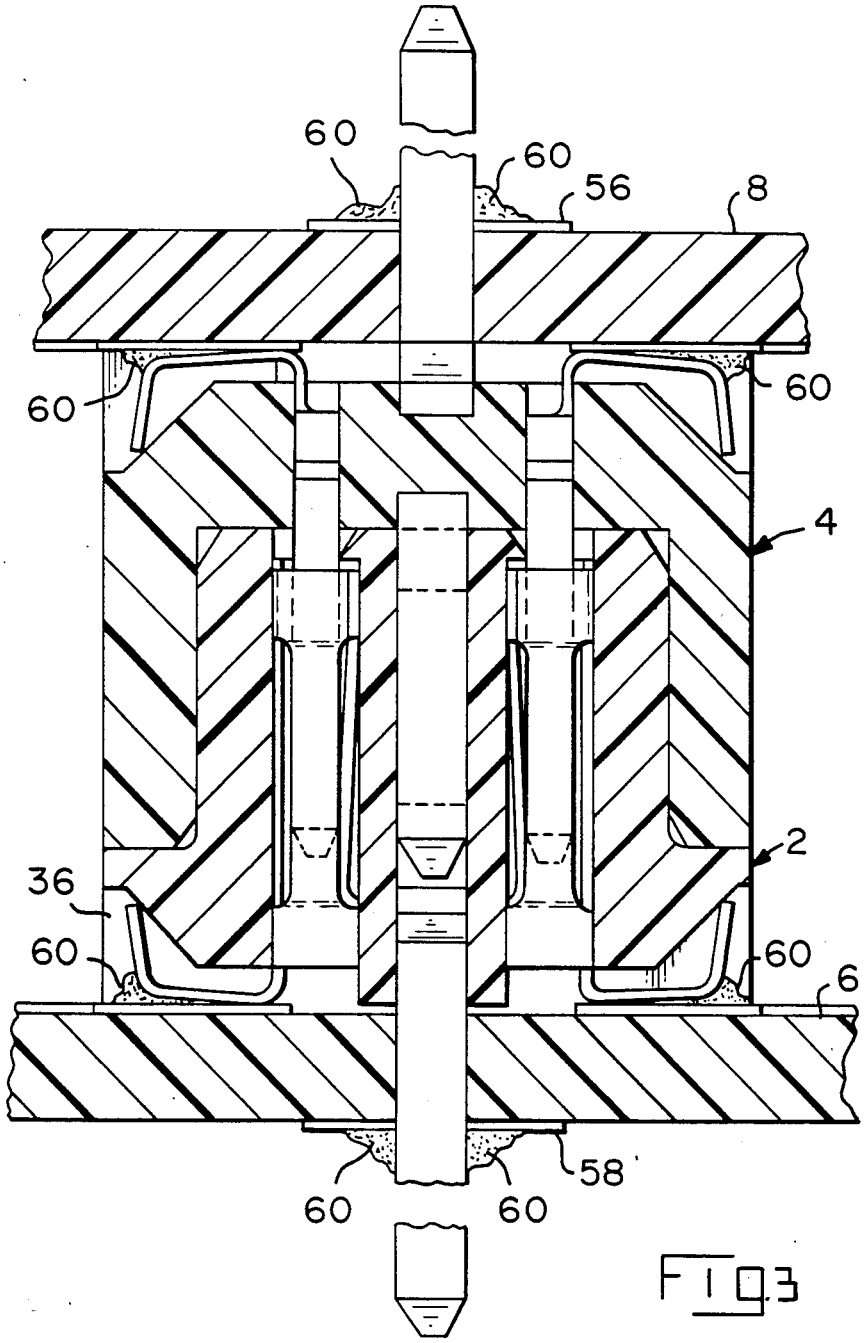
FIG. 3 is a sectional view showing the connectors of FIGS. 1 and 2 in a mated configuration establishing continuity between conductive traces on parallel printed circuit boards.

The preferred embodiment of this invention depicted in FIGS. 1 through 3 can be employed to interconnect circuits on printed circuit boards or the like disposed in parallel relationship. As shown in FIG. 1 one of the connectors 2 can be mounted on printed circuit boards 6 in such a fashion that connector 4 can be mated with connector 2. As shown most clearly in FIG. 3, connector 2 comprises a receptacle member whereas connector 4 comprises a mating pin header. Connector 4 comprises a unitary housing 10 molded of insulating material and having a plurality of pin-type terminals 20 located in two rows extending longitudinally along the sides of the connector housing. An elongated ground bus 12 formed of a relatively rigid conducting metal is positioned in the center of housing 10 between outwardly facing rows of pin terminals 20. In the preferred embodiment of this invention the ground bus 12 is insert molded in the housing 10. A pair of alignment and retention legs 14 extend in the plane of ground bus 12 from one edge. As shown in FIG. 1 the alignment and retention posts 14 comprise integral extensions of the ground bus 12. Alignment and retention posts 14 extend beyond a first or outwardly facing surface 18 of connector housing 10. On the opposite edge of ground bus 12, two cutout sections 24 and 26 are depicted. Cutout section 26 comprises an alignment means for registration with a polarization key 38 in the opposite connector. Cutout section 24 forms a receptacle portion for receiving alignment and retention post 34 in connector 2.

Each of the terminals 20 comprises a stamped and formed pin-type terminal for receipt in cavities 28 extending adjacent to and spaced from ground bus 12. The pins 20 located in cavities 28 are insulated from the ground bus 12. Ground bus 12 is precisely positioned relative to the terminals and comprises a means for controlling the impedance of signals carried through pins 20. Each of the stamped and formed terminals 20 has a solder leg 22 depending from the outermost end thereof. Solder leg 22 comprises a compliant section extending between the radiused section **22*a* at the juncture with the post 20 and the free end 22*b* of the terminal. Insertion of the pin portion of terminals 20 into cavities 28 provides a conductive path from the outwardly facing surface 18 of connector 4 to the opposite mating surface of the connector such that the pins 20 are in position to mate with corresponding receptacle terminals 40 located in connector 2. A plurality of laterally extending channels 16 are located in communication with cavities 28 along the outwardly facing surface 18 of connector housing 10. These channels 16 are positioned such that the solder tails 22 are received within the channels when the pin 20 is inserted into the terminal receiving cavities 28**.

Figure 6:
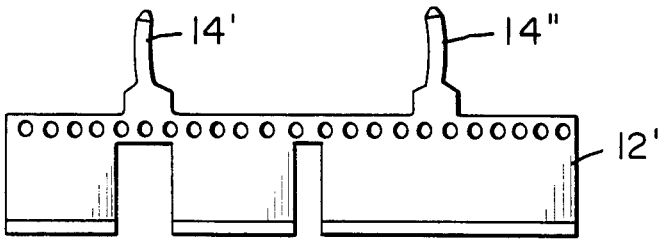
FIG. 6 is an alternate embodiment of a bus bar for use in the connector of FIG. 1.

The details of the receptacle connector 2 are best shown in FIG. 2. The receptacle connector housing 30 has a plurality of terminal receiving cavities 48 extending from the mating or upper surface as seen in FIG. 2 and the outwardly facing surface 50. A longitudinally extending groove 32 is defined in the center of housing 30 and extends between the mating surface and the outwardly facing surface 50. Fluid drains are located at the base of the groove to allow fluids to drain during the soldering operations. Groove 32 is dimensioned to receive the ground bus 12 between rows of terminals 40 when the connectors 2 and 4 are in the mating configurations shown in FIG. 3 and align the connector haves to prevent pin and socket stubbing. A web 38 interrupts groove 32 to provide a polarization key to ensure appropriate mating between connectors 2 and 4. Separate alignment and retention post 34 can be mounted in groove 32 in a post hole for precise positioning, with a portion of post 34 extending beyond the outwardly facing surface 50. The upper portion **34*a* of alignment post 34 has a slot extending along a portion thereof and a spring clip 36 of a resilient conductive material can be inserted around the upper portion 34*a* of alignment post 34 to form a tight press fit and maintain electrical continuity. Upon mating of connectors 2 and 4 the upper retention post portion 34*a* and the spring clip 36 are inserted into the cutout section 24 with the spring 36 forming contact with the edges of the cutout portion 24 to establish electrical continuity between ground bus 12 and post 34. Post 34 can in turn be inserted into a hole in the printed circuit board to precisely register the connector to the footprint on the printed circuit board. An alternate embodiment of the bus 12' is shown in FIG. 6 wherein the posts 14' and 14''** depending from the bus are oppositely bowed or curved. When inserted into corresponding holes in a printed circuit board, these bowed posts form a press or inteference fit to hold the connector on the printed circuit board.

Box contact terminals 40 dimensioned for receipt within cavities 48 each comprise a stamped and formed terminal matable with pin-type terminals 20. A compliant solder tail 42 extends from the outwardly facing end of terminal 40 positioned adjacent the outwardly facing surface 50 of housing 30. The solder tail 42 is similar to pin solder tail 22 having a tightly radiused portion **42*a* adjacent the box terminal configuration and a free end 42*b* displaced laterally outwardly from the box configuration terminal 40. Beams 44*a* and 44*b* extend axially along the contact portion of the box receptacle 40. Although only two beams are shown in FIG. 2, it should be understood that resilient beams members can be positioned on the four sides of each box terminal 40. In the preferred embodiment of this invention each of the beams 44 is arcuately formed. Beams 44*a* are convexly arcuately formed such that the center section of beam 44*a* extends laterally beyond the profile of the box terminal configuration. Other resilient beams 44*b* are also arcuately deformed such that the center section extends into the interior of the profile of the box configuration such that beams 44*b* define a concave configuration when viewed from the exterior. When pin terminals 20 are inserted into box terminals 40, the concave beams 44*b* engage the sides of the pin terminals 20 to form a secure and highly effective electrical connection. The number of beams 44*b* and the extent to which they are inwardly deformed affects the insertion force required to mate receptacles 20 with pins 40**.

Figure 4:
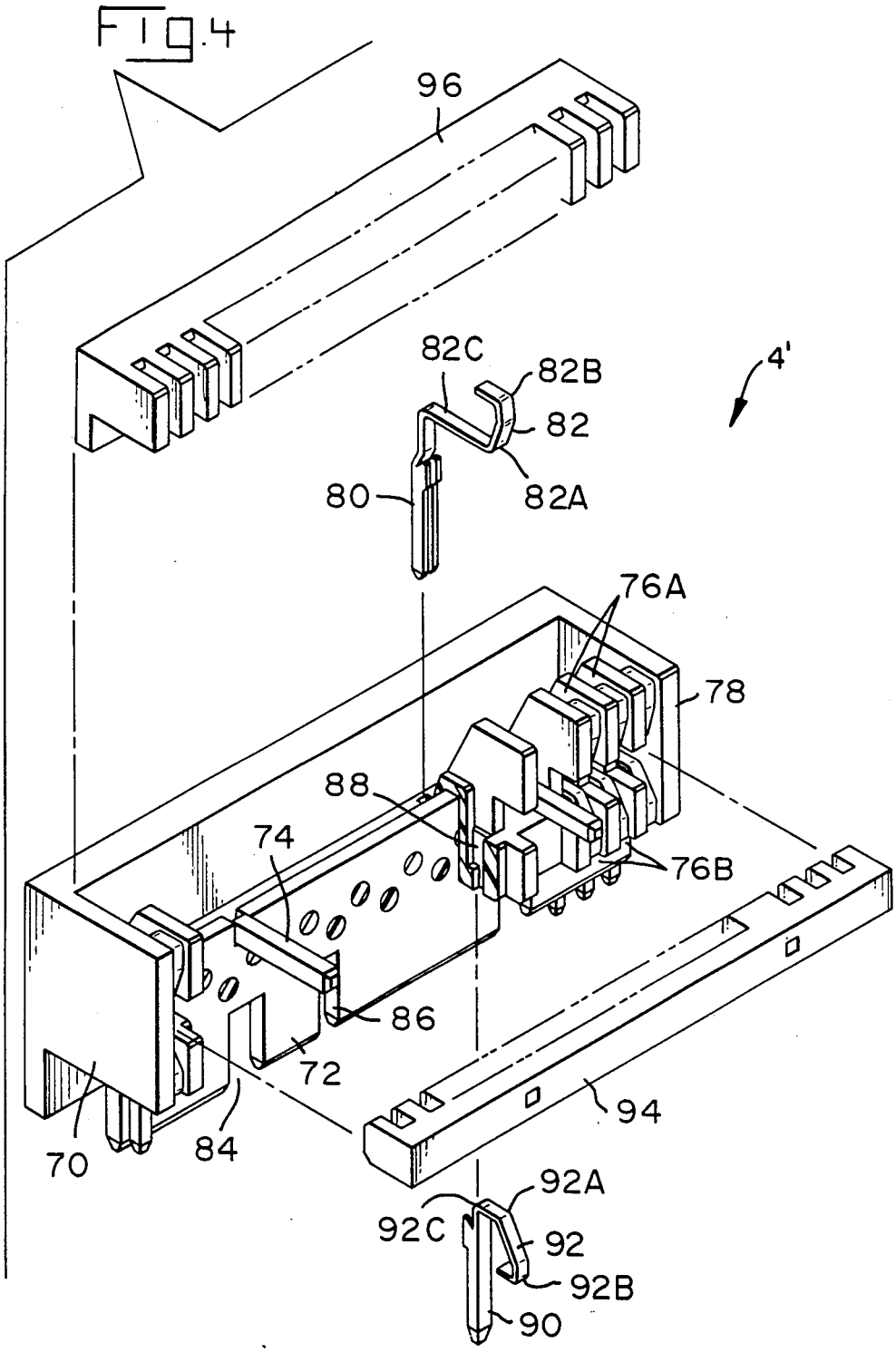
FIG. 4 is an exploded perspective view of a connector which can be employed to make interconnection between printed circuit boards disposed at right angles, when mated with a connector of FIG. 2.
Figure 5:
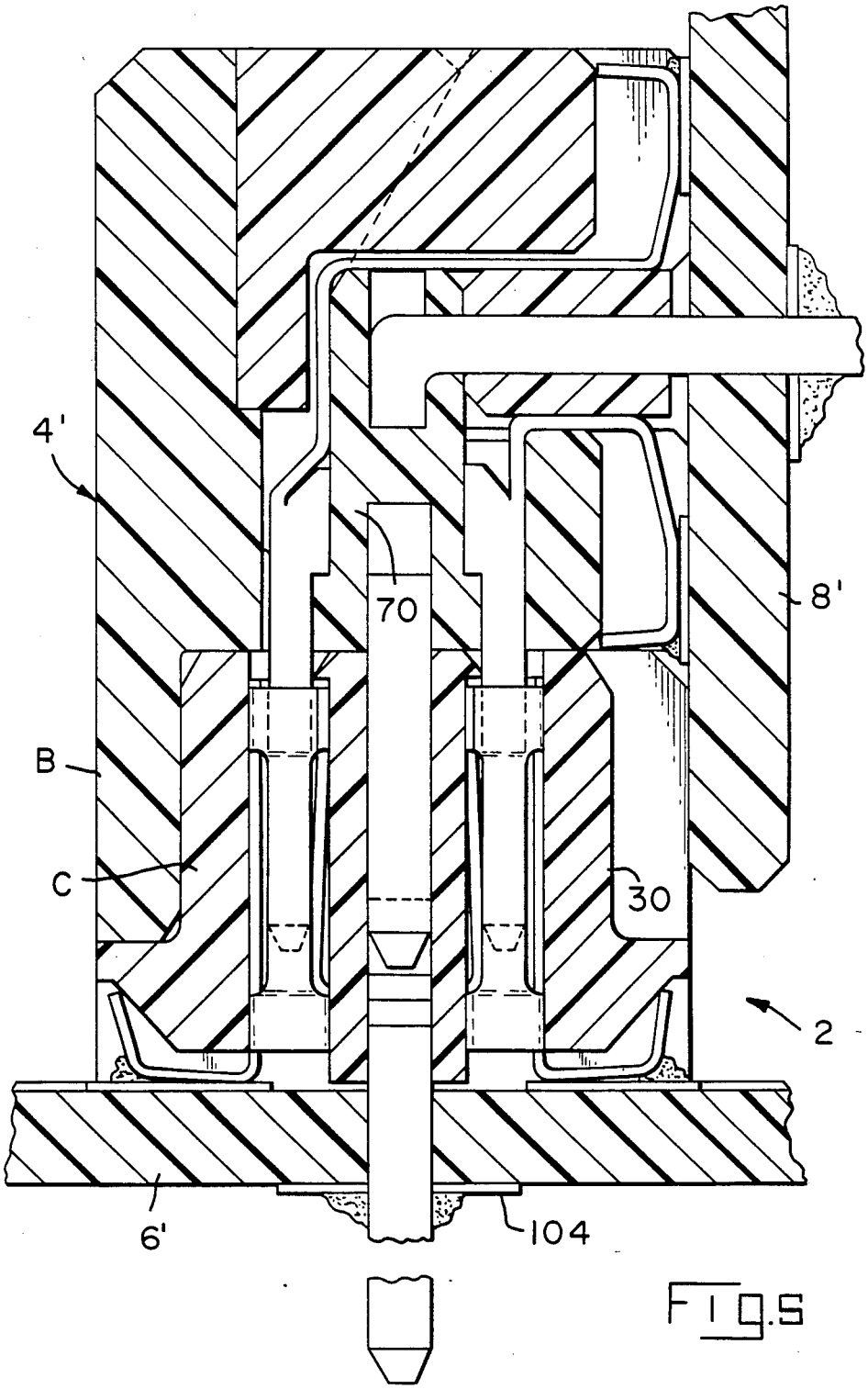
FIG. 5 is a sectional view showing the interconnection between the connector shown in FIG. 4 with a connector shown in FIG. 2 to establish communication between printed circuit boards disposed at right angles.

The configuration shown in FIGS. 1 through 3 would be employed to interconnect circuit boards disposed in parallel relationship. A pin header connector 4' shown in FIG. 4 can be employed with a receptacle connector 2 to interconnect conductive traces on tranversely or perpendicularly oriented printed circuit boards as shown in FIG. 5. The receptacle connector 4' includes a housing 70 formed of insulating material in which a ground bus 72 is inserted. As in the preferred embodiment of this invention ground bus 72 would be insert molded into housing 70. The ground bus 72 would extend between the thin terminal portions of terminals 90 arranged in two parallel rows along the sides of ground bus 72. Retention post 74, extending transversely or perpendicularly from one edge of the ground bus 70, extends beyond the outwardly facing surface 78, here located along the side of connector housing 70 to be disposed adjacent a printed circuit board. As with the preferred embodiment of the ground bus 12 shown in FIG. 1, the retention posts 74 are integral with ground bus 72, although in this configuration retention posts 74 are deformed in a right angle configuration. As shown in FIG. 5, the retention posts 74 extend between rows of terminals in the same manner as ground bus 74. An alignment cutout 86 similar to cutout 26 is defined along the lower edge of ground bus 72, again to receive a polarizing key 38 in connector 2. A second cutout portion 84 also defined into the lower edge of ground bus 72 is oriented to receive spring clip 36 and retention post 34 in the same manner as shown in FIG. 3. The terminals 80 and 90 positioned on opposite sides of ground bus 72 are each pin-type terminals having solder tails 82 and 92. The structure of the solder type tails 82 and 92 differ. As shown in FIG. 4, solder tail 82 is formed at a right angle configuration and extends along the top surface of the connector housing 70 through channels **76*a*. Solder tail 92 extends through channels 76*b* oriented oppositely from channels 76*a*. Examination of FIG. 4 discloses that solder tail 82 differs from solder tail 92 only in fact that the laterally extending section 82*c* is longer than the laterally extending section 92c and is bent in the opposite direction, to permit the solder tail to be oriented along the outwardly facing opposite side 78 of the connector housing 70. Thus solder tails 82 and 92 are positioned to establish contact with conductive traces on a transverse or perpendicularly oriented printed circuit board 8'. With the terminals 80 and 90 located within terminal receiving cavities 88 on opposite sides of ground plane 72 and with the solder tails 82 and 92 located within channel 76*a* and 76*b* respectively, an upper cap 96 and a side cap 94 can be secured to housing 70 to retain the terminals in place. Solder tails 82 and 92** are however oriented adjacent the printed circuit boards such that a soldered surface mount interconnection can be formed with conductive traces on the printed circuit boards, and the solder joints can be inspected from opposite sides.

Figure 7:
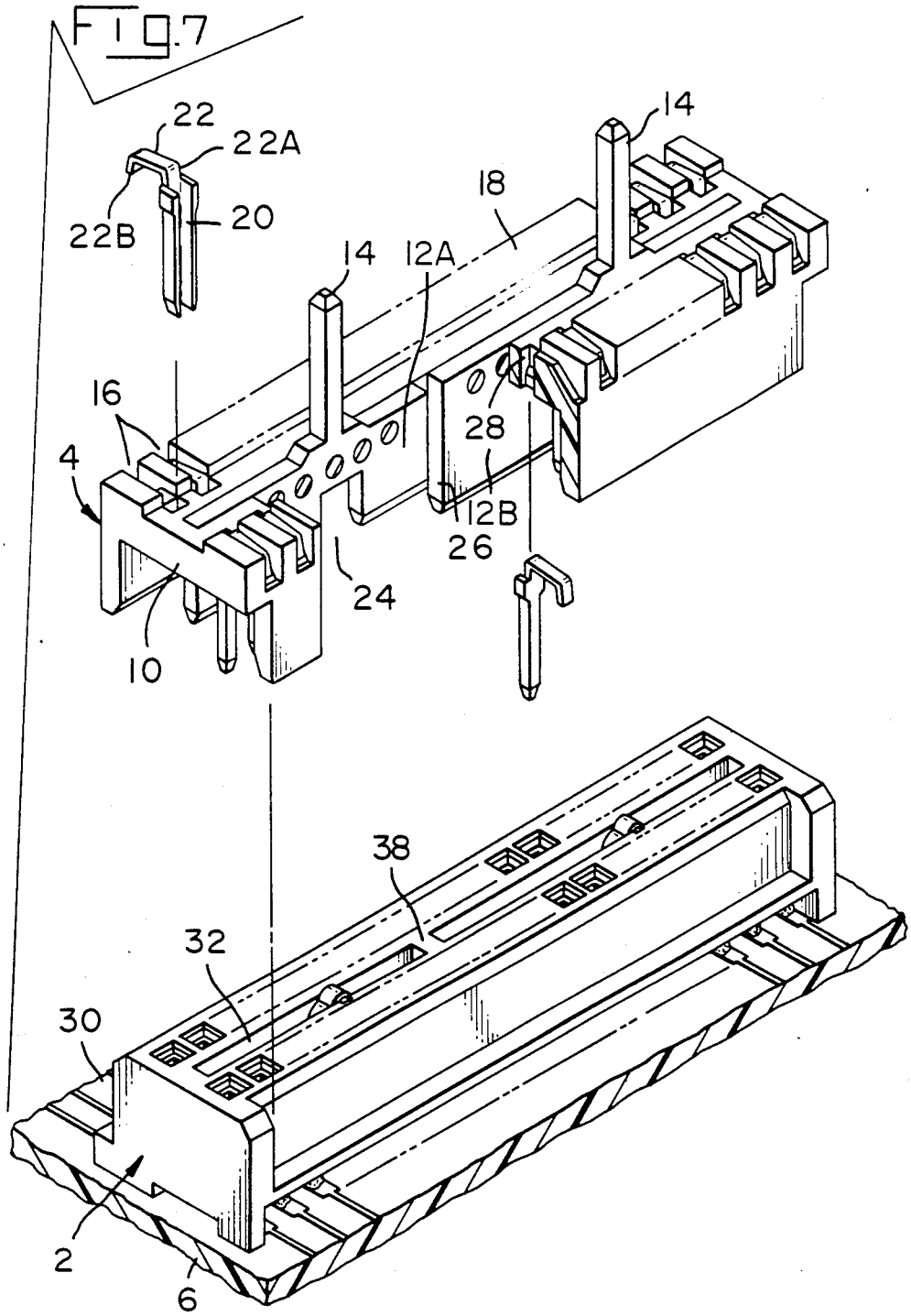
FIG. 7 is an alternate embodiment of a connector similar to that of FIG. 1, having separate ground and power buses.

An alternate embodiment of the connector employing separate ground and bus bars is depicted in FIG. 7. In this embodiment, the power bus **12*a* is shorter than the ground bus 12*b*, both of which are affixed to connector 4. When connectors 2 and 4 are mated the ground connection will be made first to discharge any static electricity prior to making the signal connection between the terminals 20 and 40**. The power connection is then made after both the ground and signal connections have been established.

Figure 8:
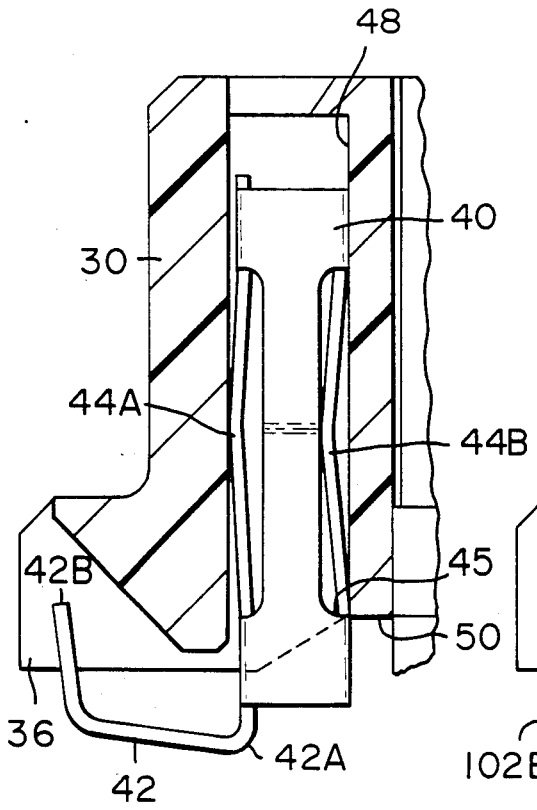
FIG. 8 is a view of a contact terminal having a solder tail in which the terminal is retained in a partially inserted position prior to mounting on a printed circuit board.
Figure 9:
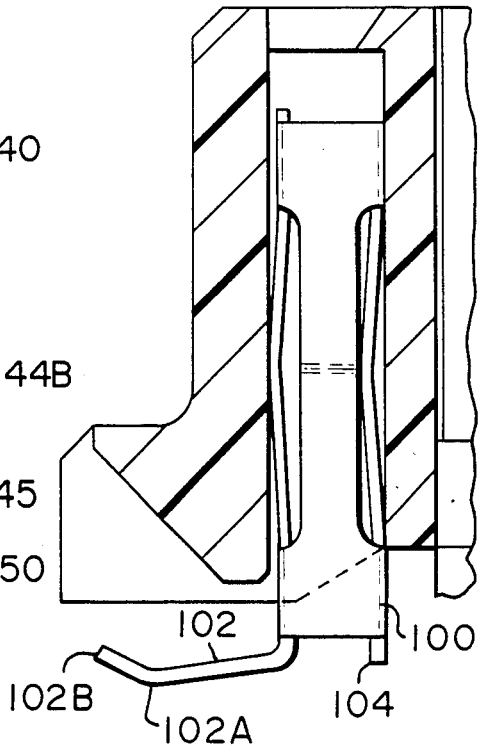
FIG. 9 is a view similar to FIG. 8 showing an alternate embodiment of the terminal employing an integral pusher member for movement of the terminal from the partially inserted to the fully inserted position.

FIGS. 8 and 9 show the manner in which the box terminals 40 are positioned within terminal receiving cavities 48. As shown in FIG. 8 the box terminals 40 can be positioned in and retained in a partially inserted configuration in which the compliant solder tails extend for a significant distance beyond the outwardly facing surface 50 which will be oriented adjacent the printed circuit boards. The outwardly facing or convex resilient beam **44*a* frictionally engages the inner wall of cavity 48 to prevent unintended movement of the terminal into the cavity and to retain the box terminal in the partially inserted configuration. An edge or surface 45 located on the box terminal also engages an edge of the surface 50 such that further insertion of terminal 40 is resisted, to maintain a preposition location. In the configuration of FIG. 8 the tightly radiused portion 42*a* of terminal 40 extends further from the outwardly facing surface. The free end 42*b* remains located within channel with the terminals loaded from the outwardly facing surface 50 into cavities 48 and retained in a partially inserted position as shown in FIG. 8, each terminal will individually contact its appropriate solder pad 54 when the housing 30 is secured to the printed circuit board through the ground bus retention system including post 34. A solder fillet will extend to the height to free end 42*b* and proper solder wicking will occur. As the housing 30 is secured to printed circuit board 6 each terminal will be individually forced into the cavity 48 and the extent to which terminals 40 are inserted in cavities 48 will depend upon the local geometry of the printed circuit board, the housing, the solder pads, and the terminals. Thus if there are any deformities in the printed circuit board or warpage of the housing, the terminals need not be evenly inserted into cavities 48. However each terminal will individually contact the solder pads despite local deformities, and will be properly inserted into the solder paste on the pads, even if the solder paste is unevenly distributed among the solder pads. Thus contact will be maintained with all conductive pads 54 on the printed circuit board. A compliant solder joint will be established since the solder tail defines a solder fillet surface and movement of the terminals within the cavities imparts compliance to the interconnection upon relative movement between the printed circuit board and connector. In the embodiment of FIG. 8, the tightly radiused portion 42 adjacent the juncture of the box receptacle 40 will be the first surface to engage pads 54**.

FIG. 9 is a view similar to FIG. 8 but showing an alternate embodiment of the box terminal 100 employing an integral pusher section 104 on the lower end of terminal 100. Pusher section 104 may be oriented on the opposite edge from solder tail 102. As the housing 30 is secured to the printed circuit board 6, the pusher 104 will engage the printed circuit board to urge terminal 100 from its partially inserted position further into cavity 48. The portion **102*a* of solder tail 102 which first comes into contact with pad 54 in the configuration of FIG. 9 is not located immediately adjacent the juncture of the box terminal portion and thus could not withstand the stresses which might be imposed on the tightly radiused section 42*a* of FIG. 8. However the configuration of FIG. 9** would have certain manufacturing advantages and electrically would perform in a similar manner.

After the connectors have been secured to respective printed circuit boards, a surface mount solder connection can be made between the solder tails and the pads, such as pads 54 on printed circuit boards 6. This surface mounting soldering operation involves a vapor phase reflow soldering operation or an alternative soldering operation such as an IR heating. This soldering step is used to render solder paste or other conductive medium, previously deposited on the pads, into a molten state so that a solder fillet 60 can be formed with the respective solder tails. Other soldering methods, such as reflow soldering, would also be useful in establishing a connection between the retention posts and pads 104 located on the lower surface of the printed circuit boards opposite from the surface mount interconnections.

This invention has been described in terms of preferred embodiments but is not limited to practice of the invention with the preferred embodiments only. Other embodiments within the scope of this invention will be apparent to those skilled in the art.

What is claimed is:

1. A surface mount electrical connector for establishing electrical continuity with solder pads on the surface of a printed circuit board comprising:

a housing having a plurality of cavities extending therein from a first surface;

electrical terminals each dimensioned for receipt in one of said housing cavities and engagable with the housing when partially inserted therein to retain the terminal in a partially inserted position and having a surface mount solder tail extending beyond the first surface of the housing when the terminal is in the partially inserted position, each terminal comprising a resilient beam member located within the housing when the terminal is in the partially inserted position, the resilient beam being frictionally engagable with an internal wall of the corresponding cavity for retaining the terminal in the partially inserted position, and a stop surface on each terminal engagable with the housing first surface adjacent the corresponding cavity when the terminal is in the partially inserted position; and means for securing the housing to a printed circuit board disposed adjacent the first surface, each terminal being independently shiftable further into the cavity and away from the printed circuit board from the partially inserted position as its solder tail is pressed against flat surfaces of said solder pads upon securement of the housing to the printed circuit board, whereby contact is independently established between the solder tails and the solder pads on the printed circuit boards despite deformities in the printed circuit board or warpage of the housing.

2. A surface mount electrical connector for establishing electrical continuity with solder pads on the surface of a printed circuit board comprising:

a housing having a plurality of cavities extending therein from a first surface;

electrical terminals each dimensioned for receipt in one of said housing cavities and engagable with the housing when partially inserted therein to retain the terminal in a partially inserted position and having a surface mount solder tail extending beyond the first surface of the housing when the terminal is in the partially inserted position, a portion of the terminal solder tail extending laterally from the housing cavity, the laterally extending portion comprising means for forming a solder fillet, each terminal forming a compliant solder joint due to movement of the terminal within the housing cavity; and means for securing the housing to a printed circuit board disposed adjacent the first surface, each terminal being independently shiftable further into the cavity and away from the printed circuit board from the partially inserted position as its solder tail is pressed against flat surfaces of said solder pads upon securement of the housing to the printed circuit board, whereby contact is independently established between the solder tails and the solder pads on the printed circuit boards despite deformities in the printed circuit board or warpage of the housing.

3. The connector of claim 2 wherein the housing comprises a plurality of laterally extending channels, the solder tails being disposed in corresponding channels.

4. The connector of claim 3 wherein free ends of the solder tails are disposed within the channels.

5. A surface mount electrical connector for establishing electrical continuity with solder pads on the surface of a printed circuit board comprising:

a housing having a plurality of cavities extending therein from a first surface;

electrical terminals each dimensioned for receipt in one of said housing cavities and engagable with the housing when partially inserted therein to retain the terminal in a partially inserted position and having a surface mount solder tail extending beyond the first surface of the housing when the terminal is in the partially inserted position, the terminals comprising box contact receptacles having first and second beams defined on opposite sides thereof and formed to receive mating contacts; and means for securing the housing to a printed circuit board disposed adjacent the first surface, each terminal being independently shiftable further into the cavity and away from the printed circuit board from the partially inserted position as its solder tail is pressed against flat surfaces of said solder pads upon securement of the housing to the printed circuit board, whereby contact is independently established between the solder tails and the solder pads on the printed circuit boards despite deformities in the printed circuit board or warpage of the housing.

6. The connector of claim 5 wherein the first and second beams are arcuately formed, the first beam engaging the cavity when the terminal is partially inserted and comprising means for frictionally retaining the terminal in the partially inserted position, the second beam comprising means for resiliently engaging a mating contact inserted therein.

* * * * *